United States Patent [19]

Glucksman

[11] Patent Number: 4,569,360

[45] Date of Patent: Feb. 11, 1986

[54] HAIR CURLING ROLLER

[76] Inventor: Dov Z. Glucksman, 26 Beacon St., Apt. 9F, Burlington, Mass. 01803

[21] Appl. No.: 556,572

[22] Filed: Nov. 30, 1983

[51] Int. Cl.[4] ..... A45D 2/12

[52] U.S. Cl. ..... 132/33 R

[58] Field of Search ..... 132/33 R, 40, 42, 39

[56] References Cited

U.S. PATENT DOCUMENTS

| | | | |
|---|---|---|---|
| 2,847,015 | 8/1958 | Davis | 132/42 R |
| 3,105,502 | 10/1963 | Mitchell et al. | 132/40 |
| 3,208,459 | 9/1965 | Kramer | 132/40 |
| 3,586,820 | 6/1971 | Yamanaka | 132/33 R |
| 3,665,939 | 5/1972 | Laing | 132/33 R |
| 3,696,819 | 10/1972 | Jensen | 132/33 R |
| 3,766,930 | 10/1973 | Madsen | 132/33 R |
| 3,867,953 | 2/1975 | Stöhr | 132/40 |
| 4,382,447 | 5/1983 | Glucksman | 132/33 R |

*Primary Examiner*—Gregory E. McNeill

*Attorney, Agent, or Firm*—John S. Roberts, Jr.

[57] ABSTRACT

A hair curling roller adapted to be heated before being placed into the hair, consists of a hollow, cylindrical, perforated cage of a material of low heat conductivity, such as a synthetic resin, provided with a plurality of outwardly projecting teeth of the same material; and of a cylindrical sleeve of a material of high heat conductivity e.g. aluminum, inserted into the cage in intimate contact therewith. The top of the roller is preferably closed by a suitable cover or cap of a synthetic resin, either integral with the cage, or as a separate unit, while the cage and the sleeve are open at their bottom.

20 Claims, 9 Drawing Figures

HAIR CURLING ROLLER

Material Information Disclosure

The following U.S. patents are cited as of interest to this application:

U.S. Pat. No. 3,858,029, 12/1979
U.S. Pat. No. Re. 26,766, 1/1970
U.S. Pat. No. 3,858,588, 1/1975
U.S. Pat. No. 3,473,005, 10/1969

BACKGROUND OF THE INVENTION

The invention relates to a hair curling roller adapted to be heated before being placed into the hair. It relates more particularly to a cylindrical hair curling roller comprising a hollow metal core and an outer plastic shell provided with a plurality of outwardly projecting teeth or pins.

Hair curling rollers are substantially cylindrical in shape and are being used by wrapping strands of hair around their periphery to shape the hair in curls or waves, with the curl or wave diameter corresponding to the outer diameter of the roller.

In order to achieve a curl that will last a reasonable length of time the hair strands should be heated while they are wrapped around the roller and should not be removed from the roller until they have cooled down.

Most rollers available are being preheated before being applied to the hair by being placed on a series of metal posts which are being heated electrically, and the temperature of which is regulated by means of a thermostat.

The conventional hair roller comprises a molded plastic cylindrical shell with integrally molded radial teeth or pins on its periphery and a metal sleeve inserted therein. The teeth or pins serve a dual purpose: they grip the hair and pull it tightly against the cylindrical surface; and the tips of the teeth remain substantially cooler than the cylinder body so that the user can touch the hot roller without burning his fingertips; in addition, the teeth keep the hot roller away from the user's head, neck or ears.

The metal sleeve is close to the heated metal post of the heating set and transfers the heat to the plastic shell, the sleeve being instrumental in equalizing the surface temperature of the roller over its entire surface. In some embodiments the rollers are equipped with an inner walled metal sleeve containing paraffin wax with the object of maintaining the temperature for a longer period, and there are some rollers without any insert at all.

The common drawback of all types of molded plastic rollers is caused by the low thermal conductivity of plastic—polypropylene, for example, has a thermal conductivity of 0.04–0.06 BTY/HR, FT, ° F., compared with Aluminum which has a conductivity of 128 BTU, HR, FT, ° F.—which means that: (a) the roller will take a long time to reach its desired outer surface temperature;

(b) When the hot roller touches the cold hair its outer surface will instantly cool down, as heat is extracted from the surface faster than it can be restored by heat flow from the body of the roller, and (c) as heat conducts slowly through the plastic medium the roller will take a long time to cool down along with the hair surrounding it, thus requiring the user to keep the rollers in the hair a long time out of fear that the warm hair would not retain the curl, after the still warm roller has been removed. It is obvious that all 3 problems would be alleviated if the roller was made of aluminum.

The present invention has, therefore, been conceived with the following objects in mind:

(1) To provide a hair roller which can be rapidly heated while being placed on the post of a heating set, which will impart its heat instantly to the hair wrapped around it and which will cool off rapidly after its heat has been absorbed by the hair.

(2) To provide such hair roller with plastic teeth which will not reach the temperature of the main body and will remain cool enough to be held by the user's fingers.

SUMMARY OF THE INVENTION

In a first embodiment of the roller according to the present invention which is suitable for being heated on a cylindrical post of the heating unit, the roller consists of a hollow, cylindrical, perforated cage of a material of low heat conductivity, such as a synthetic resin, provided with a plurality of outwardly projecting teeth of the same material; and of a cylindrical sleeve of a material of high heat conductivity, e.g., aluminum, inserted into the cage in intimate contact therewith. The top of the roller is preferably closed by a suitable cover or cap of a synthetic resin, either integral with the cage, or as a separate unit, while the cage and the sleeve are open at their bottom, the inner diameter of the sleeve being slightly larger than the post of the heating unit.

In a preferred embodiment of the hair roller which is adapted to be heated on on a frusto-conical post of a heating unit, the cage is of a cylindrical diamter throughout, its top being closed by a cover or cap of a similar material while the bottom is open. The cage, in a preferred embodiment, consists of several circular hoops and stays, while the top and the bottom portion respectively are in the shape of full, not perforated cylinders.

The cage may also comprise a flanged top portion and a flanged bottom portion interconnected by several straight stays and by at least one solid band extending helically between the top and bottom portions and defining the inner cylindrical space of the cage. A plurality of outstanding teeth or pins are provided on the outer peripheral surface of the helical bands.

In another embodiment the cage may comprise several circular hoops and several length-wise extending stays, said stays being provided with a plurality of outwardly projecting teeth or pins.

The cap consists generally of a circular, flat top plate, and of a skirt extending into the top portion of the hair roller for a length sufficient to hold the cap in secure position.

The sleeve consists of an upper, cylindrical main portion which adheres closely to the inside of the cage, and of a lower, shorter, neck portion of smaller diameter which is spaced apart from the cage wall. The neck portion is slotted by a plurality of slots permitting the outward expansion of the neck portion whenever the roller is being positioned on a frusto-conical post of a roller heating set. The slots are preferably parallel to the sleeve axis starting from the bottom end and terminating above the upper end of the neck portion. Their width is determined in a manner permitting the remaining rectangular sections or blades between each two slots to be joined and to form the circumference of the neck portion.

In a preferred embodiment of the roller the sleeve is slit length-wise and is, prior to its being inserted into the cage, of a somewhat larger outside diameter than the inner diameter of the cage; this feature permits its insertion into the cage in contraced state, and its subsequent expansion towards the inner surface of the cage, thus providing intimate contact. The sleeve extends preferably from the top of the cage to a short distance from the bottom end of the cage, but it may be shorter in its top portion in all cases where the cap is inserted into the cage in contact with the cage walls.

There are provided various means serving to secure the sleeve in lengthwise direction: a preferred means consists of an inwardly extending collar provided in the lower portion of the cage and abutting on the bottom end of the upper cylindrical portion of the sleeve. A second means consists in inwardly projecting, lengthwise extending ribs, abutting on the bottom end of the upper cylindrical portion. A third means serving to secure the sleeve both in lengthwise as well as in radial direction consists in at least one lug projecting from the inner surface of the cage and mating with at least one corresponding recess or perforation in the sleeve.

With a view to securing the sleeve in the cage against rotation the cage is advantageously provided with a longitudinal ridge protruding out of its inner surface, and engaging with the longitudinal slot in the sleeve.

In a preferred embodiment of the hair roller the skirt of the cap is of an outer diameter cooperating with the inner diameter of the sleeve at its upper end, and is provided with a circular concave indentation which mates with protrusions on the inside of the sleeve.

In order to prevent crooked positioning of the roller on the heated post the bottom end of the cage may be provided with an inner collar of a diameter slightly larger than that of the post. With the similar object in view a third collar is provided on the cage inside in a location corresponding to the bottom end of the neck portion of an inner diameter slightly larger than the outer diameter of the portion at its bottom end. This collar prevents the blades from being bent beyond their elastic yield point.

In another embodiment of the roller having a reduced diameter neck portion the upper-cover is integral with the cylindrical portion of the cage while the first, second and third collars are comprised in one sleeve to be inserted into the cage from its bottom end and to be held in position by securing means.

DESCRIPTION OF THE PREFERRED EMBODIMENTS

Figure 1:
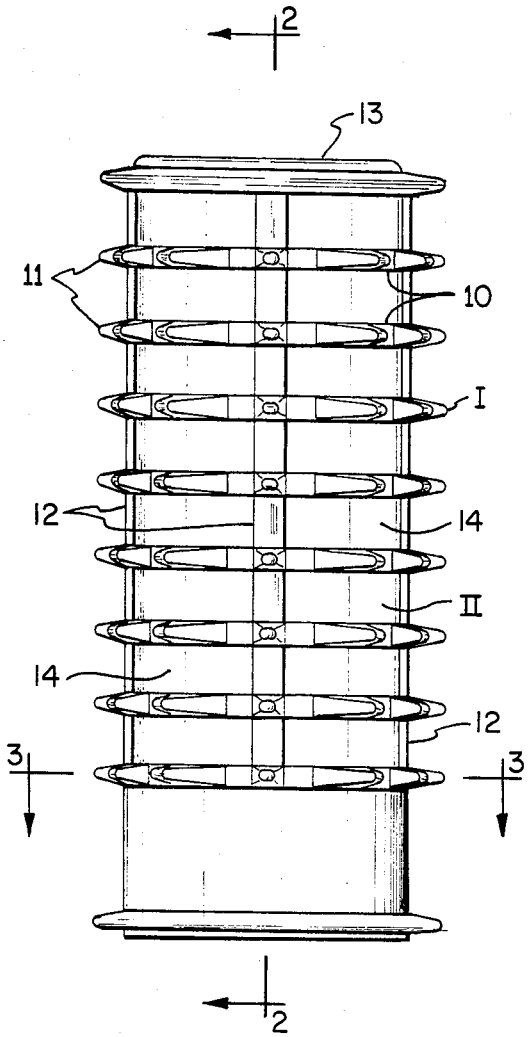
FIG. 1 is an elevation of a hair curling roller provided with a cylindrical sleeve.
Figure 2:
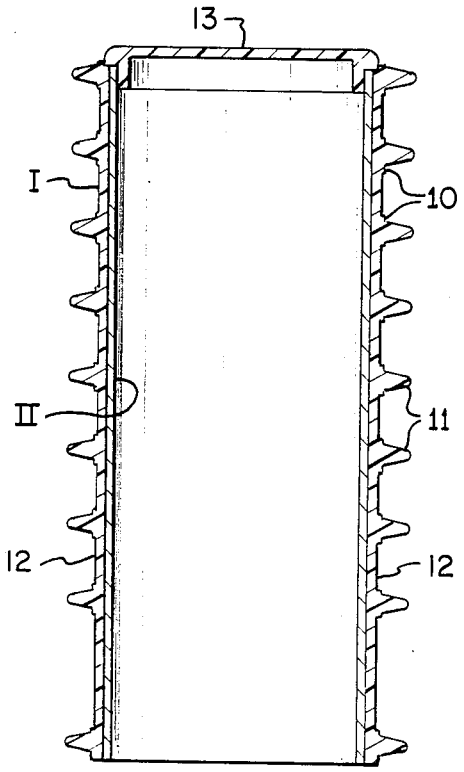
FIG. 2 is a longitudinal section of the roller illustrated in FIG. 1.
Figure 3:
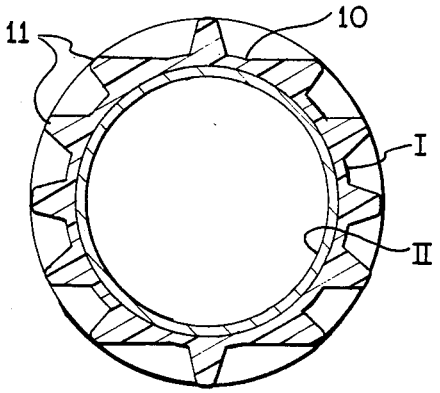
FIG. 3 is a cross section of the roller along the line A—A of FIG. 2.

With reference to FIGS. 1 through 3, a hair curling roller consists of a cage of a synthetic resin I and a cylindrical sleeve of a heat-conductive material II. The cage comprises several circular hoops 10 with teeth 11 protruding therefrom in outward direction, the hoops being interconnected by four rows of stays 12 extending in longitudinal direction. The cage is closed by a cover 13 which is shown in the drawing to be integral with the upper end of the cage, but as an alternative it may be attached to the cage in the form of a separate cap. The hoops and the stays form between them large openings 14 which permit direct contact between hair and metal sleeve.

The metal sleeve II of the present embodiment is in the shape of a hollow cylinder which fits closely into the cage and is immovable therein; rigid connection between cage and sleeve (not shown in the drawing) can be by such known means as internal lugs on the cage's inner surface in engagement with corresponding holes in the sleeve, or by friction which can be obtained, during manufacture, by shrinking the hot cage onto the cold sleeve.

Although the use of cylindrical posts for heating the hair is wide spread, contact between the sleeve and the post cannot be close enough for satisfactory heat transfer, since there exists a gap between their two surfaces which is necessary for ready placing and removing the roller on the post. Much better heat transfer can be obtained by employing a heated frusto-conical post and a sleeve longitudinally slotted in its lower portion, by a number of parallel slots. The sleeve diameter is slightly larger than the upper end of the cone-frustum, and by placing the sleeve on the post, the elastic blades created by and between the slots expand and cling closely to the outer surface of the post, thus enabling the heat transfer from post to roller.

Figure 4:
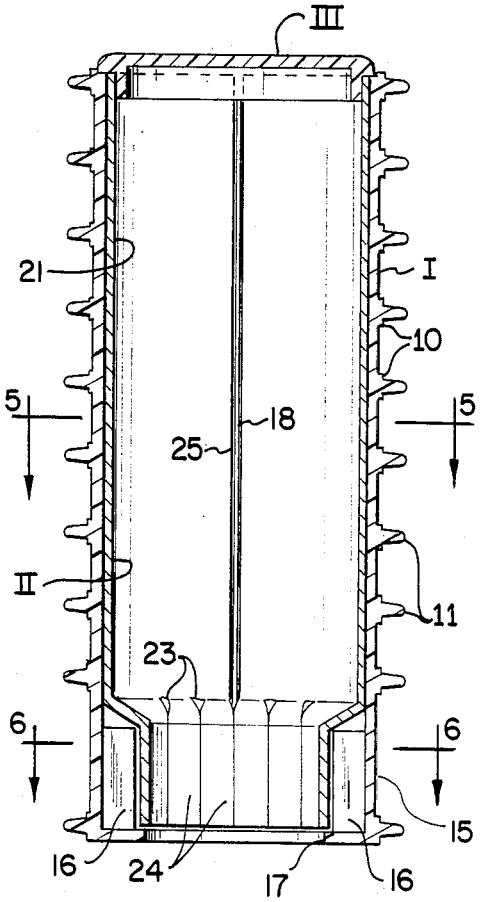
FIG. 4 is a longitudinal section of a hair curling roller provided with a stepped sleeve.
Figure 5:
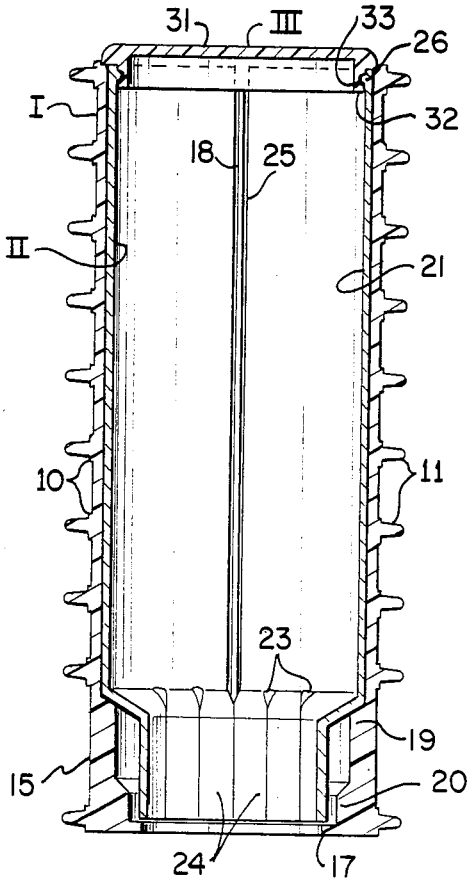
FIG. 5 is a cross section of the roller along the line C—C of FIG. 4.
Figure 6:
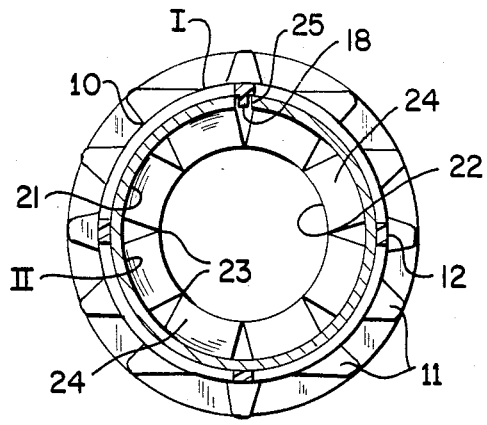
FIG. 6 is a cross section of the roller along the line B—B of FIG. 4.

Referring to FIGS. 4, 5 and 6 of the drawings a roller of this kind consists of a cage I, a stepped sleeve II and a cap III. The cage comprises circular hoops 10 provided with outwardly extending teeth 11 which are interconnected by longitudinal stays 12, similar to the roller depicted in FIG. 1. It differs from the latter roller in that the spaces between the three lowermost hoops are filled with material so as to form a solid cylinder 15, similarly provided with teeth 11. Several longitudinal ribs 16 extend from the inside of the cylinder in inward direction; they serve to support the stepped sleeve II and prevent its lengthwise movement in the cage. An inwardly extending collar 17 surrounds the lower end of the cylindrical portion 15 of the cage. A key or ridge 18 extends along the cage inside.

The sleeve II comprises a smooth, cylindrical main portion 21 extending from the top of the cage to a point above and close to the ribs 16, from where it is stepped down to a cylindrical neck portion 22 of smaller diameter. The neck portion is slotted by several longitudinal slots 23 forming a like number of elastic blades 24 between each two slots. The blades 24 form the circumference of the cylindrical neck and are adapted to expand whenever the roller is seated on a frusto-conical post of a heater so as to closely adhere to the heater post.

The sleeve is slotted along its entire length, resulting in a longitudinal open slot 25 in the main cylindrical portion, which engages with the key or ridge 18 in the cage, thus preventing rotation of the sleeve in the cage.

A plastic cap III covers the top of the roller and is rigidly fastened to the cage in a manner which makes its removal substantially impossible.

The sleeve is formed by rolling or bending a rectangular sheet of metal, e.g., aluminum of predetermined dimensions. Before deformation a number of slots 23 are cut into one side of the sheet, whereby the total width of all slots is equal to or greater than the circumference of the main cylinder minus the circumference of the neck portion. After the rolling or bending operation the diameter of the open cylinder is left to be larger than the inner diameter of the cage, in order to permit its elastic expansion after insertion into the latter. However, before its insertion, the neck portion is formed by pressing it in a suitable die, whereby the edges of the slots 23 are approached to each other thus obtaining a virtually closed cylinder. In order to insert the sleeve into the cage, it is contracted to the cage diameter in a known manner and pushed into the cage interior until it is stopped by the ribs 16 provided on the inside of the cage. The sleeve is now released and allowed to expand in such an alignment that the key or ridge 18 of the cage cooperates with the slot 25 in the sleeve.

Figure 7:
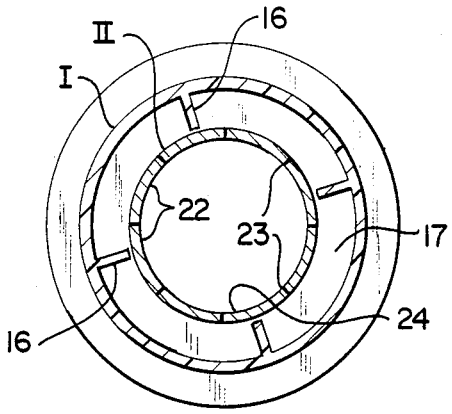
FIG. 7 is a longitudinal section through a modified hair curling roller.

The hair roller of FIG. 7 is in most parts identical with that illustrated in FIGS. 4, 5, and 6, and identical numerals are being utilized to indicate identical parts of the two embodiments. The sleeve II itself is substantially the same in both kinds of rollers except for the additional internal protrusions 26 in the top portion of the sleeve in FIG. 7 which mate with a circular recess (33) in the cap III.

The cap III comprises of a flat circular top plate 31 and a cylindrical skirt 32 attached thereto, the outer diameter of the skirt corresponding to the inner diameter of the sleeve II. A circular recess 33 is provided in the outer surface of the skirt 32, which engages with three or more protrusions 26 in the sleeve, and serves to keep the cap in position relative to the sleeve, while the latter is secured in the cage by friction only.

Characteristic differences in the design of the cages as illustrated in FIGS. 4 and 7 respectively lie in the replacement of the ribs 16 by a stepped, internal collar 19, 20 on the inside of the cylindrical portion 15. The collar extends from the collar 17 at the bottom end of the cage—which is identical in both embodiments—to the lower end of the upper cylindrical portion of the sleeve II, serving to prevent movement of the sleeve in downward direction, which may be caused by friction with the post during withdrawal of the roller. At its lower end the collar is stepped to a smaller diameter (20) which is slightly larger than the outer diameter of the neck portion formed by the blades 24. This portion of the collar—as well as the collar 17—will prevent crooked or oblique positioning of the roller onto one of the posts of the heating unit, and the subsequent, permanent deformation of the blade.

In all other respects, both as to the construction and their assembly, the two embodiments are identical.

Figure 8:
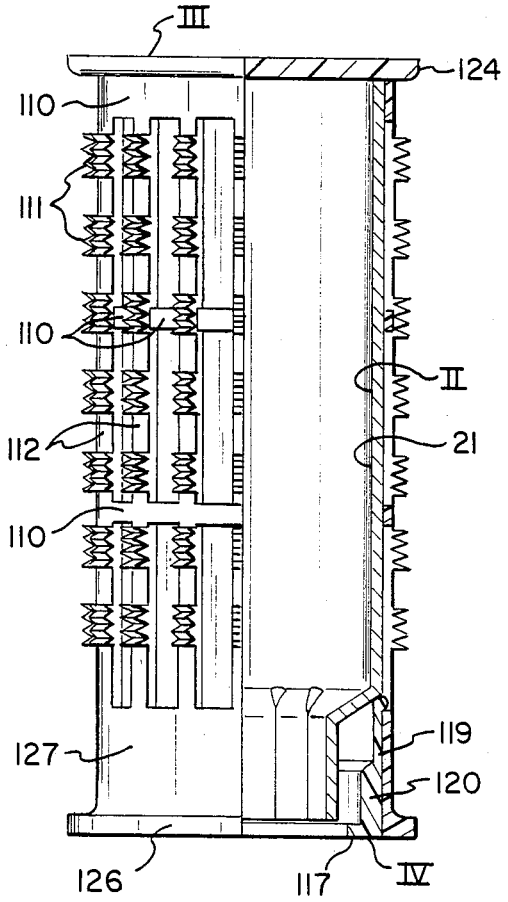
FIG. 8 is part section and part view of the modified hair curling roller provided with an integral top cover and a stepped sleeve secured in its bottom portion.

FIG. 8 illustrates yet another embodiment of a hair curling roller wherein the sleeve is identical with that shown in FIGS. 4, 5, and 6 while the cage is of different construction. The cage I comprises an upper cover III which extends outwardly in the shape of a flange 124. A similar flange 126 surrounds the bottom end of the cage. Adjacent the lower flange the cage is continued in the form of a short cylinder 127, the remaining portion of the cage being formed by a plurality of parallel stays 112 and concentric hoops 110. The inside walls of the stays and the hoops are smooth and define the cylindrical hollow space of the cage. Teeth or pins 111 are evenly distributed along the stays 112 and extend outwardly therefrom. A metal sleeve II is positioned inside the cage and extends from the inside of the cover III to a small distance off the bottom end of the cage. A sleeve insert IV is securely fastened inside the cylindrical portion 127, its upper end abutting on the lower end of the main portion of the sleeve.

The sleeve insert is stepped so as to form a thin anulus 119, a thicker annulus 120 and an inwardly extending flange 117, at its bottom end.

This arrangement permits the insertion of the sleeve II into the cage I through the bottom end with subsequent insertion of the sleeve insert IV with the object to secure the sleeve in its position.

Figure 9:
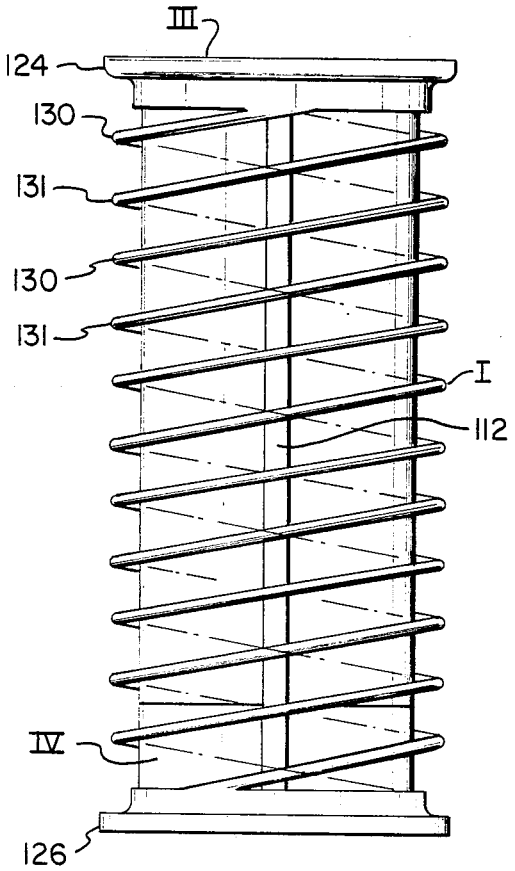
FIG. 9 is a view of another embodiment of the hair curling roller comprising a cage of toothed helical bands.

It is obvious that the sleeve insert renders the removable cap III superfluous, which can be replaced by a fixed cover, integral with the perforated cage. FIG. 9 is a side view of a hair curling roller of still another construction. The cage I comprises an upper flange 124 and a lower flange 126 interconnected by two straight longitudinal bars 112 (only the front one being visible) and by two helical bands 130 and 131. The inside walls of the stays and helical bands define a smooth cylindrical hollow space adapted to closely surround a metal sleeve II. A plurality of spikes or teeth 111 are integral with the bands 130, 131 and extend outwardly from their outer surface. The sleeve II is similar to the sleeve shown in FIG. 4, and is axially supported by an sleeve insert IV similar to that illustrated in FIG. 8.

The material of the cage and the cap is a plastic which is sufficiently heat resistant, as for instance polycarbonate, NYLON, or polypropylene. The sleeve is made from a sufficiently resilient aluminum alloy sheeting such as, for instance 1100 alloy H14, since it is important that the sleeve and the blades of the neck portion retain their elasticity even after numerous heating and cooling cycles.

It will be understood that the foregoing drawings and descriptions represent only five embodiments of the many designs to which the hair curler roller may be constructed, and many variation and modifications may be carried out by a person skilled in the art, though within the spirit of the invention and the scope of the appended claims.

Instead of constructing the cage in the form of parallel hoops and stays, or of spiral bands any other configuration may be possible, as long as a maximum of open spaces is available between the construction elements.

The number of slots and their arrangement in the neck portion may be modified by any sort of variation, as long as they permit outward expansion of the neck blades and their return to their original shape.

The cover III is not imperative, but it is advantageous in order to prevent heat from being dissipated along the roller into the atmosphere.

I claim:

1. A hair curling roller having a top and a bottom end, adapted to be heated while its bottom end is seated on a heated post of a heating unit, comprising a hollow, cylindrical cage made of a synthetic resin of a substantially cylindrically smooth inner surface, provided with a plurality of outwardly projecting teeth integral therewith, and with perforations positioned in the spaces between said teeth, and a generally cylindrical sleeve of a metal of high thermal conductivity positioned inside said cage, said cage and said sleeve being in intimate contact over at least the major part of the length of both cage and sleeve, and said perforations being of a size permitting strands of hair to contact said sleeve through said perforations.

2. The hair curling roller of claim 1 adapted to be heated while seated on a frusto-conical post of a heating unit, wherein said sleeve comprises a top portion of cylindrical configuration closely adhering to the inner surface of said cage, and a neck portion of smaller diameter adapted to fit onto said frusto-conical post of said heating unit, said neck portion being provided with slots arranged in such a manner that said neck portion is free to expand outwardly so as to adhere to the surface of said post.

3. The hair curling roller of claims 1 and 2 where said cage consists of a plurality of parallel, circular hoops provided with said outstanding teeth, said hoops being interconnected by several parallel rows of stays integral with said hoops.

4. The hair curling roller of claim 3 wherein the top portion of said cage is in the shape of a hollow, non-perforated cylinder.

5. The hair curling roller of claim 3 wherein the space between the three lower rows of teeth is filled with material, thus forming a hollow, cylindrical bottom portion.

6. The hair curling roller of claim 5 wherein several ribs project inwardly from said cylindrical bottom portion of said cage, stopping short of said neck portion of said sleeve.

7. The hair curling roller of claim 2 wherein said cage is provided in its bottom portion with an internal collar extending from the bottom end of the sleeve to the lower end of the upper, cylindrical portion of said sleeve.

8. The hair curling roller of claim 2 wherein said cage is provided with an internal collar at a height corresponding to the bottom end of said neck portion, said collar being of an inner diameter slightly larger than the outer diameter of said neck portion.

9. The hair curling roller of claim 2 wherein the bottom end of said cage is provided with an internal collar of an inner diameter slightly larger than the outer diameter of said frusto-conical post of said heating unit.

10. The hair curling roller of claim 5 wherein said cage is of a substantially uniform inner diameter and is provided at its lowermost portion with an insertable stepped sleeve insert serving to secure said metal sleeve in its position in said cage.

11. The hair curling roller of claim 2 wherein said sleeve extends from the top of said cage to a short distance from the bottom end of said cage.

12. The hair curling roller of claim 2 wherein said cage is provided along its inside with a longitudinal ridge or key which cooperates with a longitudinal slot in the cylindrical top portion of said sleeve.

13. The hair curling roller of claim 2 wherein said neck portion is slotted by several parallel, longitudinal slots, each two adjacent slots forming an elastic blade of material therebetween.

14. The hair curling roller of claim 13 wherein the total width of all said slots equals the circumference of said cylindrical top portion minus the circumference of said neck portion of said sleeve.

15. The hair curling roller of claim 2 wherein said upper cylindrical portion of said sleeve is urged towards the inner surface of said cage by outwardly acting elasticity of said sleeve material.

16. The hair curling roller of claim 1 which is closed at its top end by a cap of a synthetic resin.

17. The hair curling roller of claim 16 wherein said cap consists of a flat, circular top plate and a cylindrical skirt attached thereto, said skirt extending into the top portion of said roller.

18. The hair curler roller of claim 17 where said skirt of said cap is of an outer diameter corresponding to the inner diameter of the top portion of said sleeve.

19. The hair curling roller of claim 1 wherein said cage is made of a synthetic resin, such as polypropylene.

20. The hair curling roller of claim 1 wherein said sleeve is made of aluminum alloy sheeting.

* * * * *